US012286772B2

(12) United States Patent
Amat Holgado et al.

(10) Patent No.: US 12,286,772 B2
(45) Date of Patent: Apr. 29, 2025

(54) SYSTEM FOR FIXING WEAR ELEMENTS ON EARTH-MOVING MACHINES

(71) Applicant: METALOGENIA RESEARCH & TECHNOLOGIES, S.L., Barcelona (ES)

(72) Inventors: Carlos Amat Holgado, Barcelona (ES); Javier Jimenez Garcia, Barcelona (ES)

(73) Assignee: METALOGENIA RESEARCH & TECHNOLOGIES, S.L., Barcelona (ES)

( * ) Notice: Subject to any disclaimer, the term of this patent is extended or adjusted under 35 U.S.C. 154(b) by 208 days.

(21) Appl. No.: 17/435,378

(22) PCT Filed: Mar. 2, 2020

(86) PCT No.: PCT/ES2020/070149

§ 371 (c)(1),
(2) Date: Aug. 31, 2021

(87) PCT Pub. No.: WO2020/178466

PCT Pub. Date: Sep. 10, 2020

(65) Prior Publication Data

US 2022/0145594 A1 May 12, 2022

(30) Foreign Application Priority Data

Mar. 1, 2019 (WO) ..... PCT/ES2019/070125

(51) Int. Cl.
*E02F 9/28* (2006.01)

(52) U.S. Cl.
CPC ..... *E02F 9/2841* (2013.01); *E02F 9/2825* (2013.01); *E02F 9/2833* (2013.01)

(58) Field of Classification Search
CPC ..... E02F 9/2833; E02F 9/2841; E02F 9/2825; E02F 9/2816; E02F 9/28
See application file for complete search history.

(56) References Cited

U.S. PATENT DOCUMENTS

RE33,042 E 9/1989 Emrich
5,983,534 A 11/1999 Robinson et al.
(Continued)

FOREIGN PATENT DOCUMENTS

DE 202011101484 U1 * 1/2012 ..... E02F 9/2825
ES 2358627 T3 5/2011
ES 2628493 T3 8/2017

OTHER PUBLICATIONS

European Patent Office, Written Opinion of the International Searching Authority, International Application No. PCT/ES2020/070149.

*Primary Examiner* — Adam J Behrens
*Assistant Examiner* — Blake E Scoville
(74) *Attorney, Agent, or Firm* — Equip LG; Christopher Quan

(57) ABSTRACT

A system for fixing wear elements in earth-moving machines is provided which comprises a stem that rotates between a locking position and a release position, with locking elements including a first deformable locking element placed at the inner end of the stem and a second locking element arranged towards the outer end of the stem. This system allows for providing a an easy to manipulate and improved manner of securing the contacts between the tooth and the tooth-holder of an earth-moving machine.

20 Claims, 7 Drawing Sheets

(56) References Cited

U.S. PATENT DOCUMENTS

| | | | | |
|---|---|---|---|---|
| 6,757,995 | B2 * | 7/2004 | Pippins | E02F 9/2875 172/683 |
| 7,178,274 | B2 * | 2/2007 | Emrich | E02F 9/2841 37/453 |
| 9,920,504 | B2 * | 3/2018 | Bierwith | E02F 9/2891 |
| 10,106,960 | B2 * | 10/2018 | Jeske | E02F 9/2858 |
| 2004/0237354 | A1 | 12/2004 | Emrich | |
| 2007/0261278 | A1 | 11/2007 | Campomanes | |
| 2008/0209772 | A1 * | 9/2008 | Cui | E02F 9/2841 37/456 |
| 2014/0215868 | A1 * | 8/2014 | Johnston | E02F 9/2816 37/455 |
| 2015/0027009 | A1 | 1/2015 | Vannitamby et al. | |
| 2017/0096799 | A1 * | 4/2017 | Vegunta | E02F 9/2841 |
| 2017/0145665 | A1 | 5/2017 | Jeske et al. | |

* cited by examiner

SYSTEM FOR FIXING WEAR ELEMENTS ON EARTH-MOVING MACHINES

CROSS-REFERENCE TO RELATED APPLICATIONS

This application is a 371-national stage application of Patent Cooperation Treaty international application Ser. No. PCT/ES2020/070149, filed Mar. 2, 2020, entitled "SYSTEM FOR ATTACHING WEAR ELEMENTS TO EARTH-MOVING MACHINES", which claims the benefit and priority of Patent Cooperation Treaty international application Ser. No. PCT/ES2019/070125, filed Mar. 1, 2019, entitled "SYSTEM FOR THE ATTACHMENT OF WEAR ELEMENTS IN EARTH-MOVING MACHINERY", the contents of all of which is are hereby incorporated by reference in its their entireties.

The present invention relates to a system for fixing wear elements in earth-moving machines, in particular, to a system for fixing a tooth to a tooth-holder of an earth-moving machine, although it can also be used for fixing any wear element, including lip guards and side guards.

BACKGROUND OF THE INVENTION

Earth-moving machines, such as, for example, excavators or loaders for construction work, mining, etc. comprise a shovel or bucket that is subjected to high stresses and great erosion, especially in the area of the lip (also called blade).

For this reason, in general, the lips tend to have a plurality of protection or wear elements incorporated, such as:

- teeth: they have the function of penetrating the ground and protecting the blade of the bucket or shovel,
- tooth-holder or adapter: they have the function of protecting the blade and, above all, supporting the teeth,
- front guards: they protect the lip in the areas between the teeth and also fulfill a penetration function, but to a lesser extent than the tooth,
- Side guards: protect the sides of the shovel or bucket.

All these elements, usually called wear or protection elements, are subject to strong mechanical stresses, plastic deformations and heavy wear. For this reason it is usual that they must be replaced with a certain frequency, when the wear suffered requires it.

The wear or protection elements can be mechanically fixed, being easier and faster to change or they can be welded, being cheaper but difficult to change and with the risk of damaging the blade with welding.

At present, systems for fixing wear elements are known, which have the disadvantage that once assembled they do not tighten the tooth/tooth-holder system, that is, when the tooth is mounted on the nose of the tooth-holder, fitting has an undesired movement which makes the entry of fines easier during work.

This unwanted movement is due to the fact that, as the tooth is not tightened on the tooth-holder, or what is the same, that the contact planes of the tooth with the tooth-holder are not tightened, there is a relative movement between the contact planes that has two effects, one, to facilitate the entry of fines and two, said contact surfaces rub against each other, increasing internal wear, while worsening said contacts and increasing the problem. Once the fitting stops working properly, all the effort is supported by the pin, overloading it until it breaks.

This problem is solved by tightening the tooth on the tooth-holder, that is, maintaining the contacts between the tooth and the tooth-holder, to avoid unwanted movement, and it is achieved from the pin system, which has a mechanism to tighten the tooth on the tooth-holder, avoiding the movement between them.

Another advantage of the pin system is that it is easy to mount with a tool i without the use of force.

Some fixing systems, such as those described in U.S. Pat. Nos. 8,122,621 and 9,493,930 do not have a physical stop for disassembly rotation.

Therefore, an objective of the present invention is to provide a system for fixing wear elements in earth-moving machines that is easy to manipulate and that improves/secures the contacts between the tooth and the tooth-holder.

DESCRIPTION OF THE INVENTION

The aforementioned drawbacks are solved with the fixing system of the invention, presenting other advantages that will be described below.

The system for fixing wear elements in earth-moving machines according to the present invention comprises a stem that is rotatable between a locking position and a release position, said stem defining an inner end and an outer end, said stem comprising some locking elements, wherein said stem comprises a first deformable locking element positioned at the inner end of said stem and a second locking element arranged shifted towards the outer end of said stem.

In this way, a fixing system is achieved that locks the wear element at the two ends of the stem, that is, in separate positions, which makes the fixation more stable and reliable.

According to a preferred embodiment, said first locking element has a polygonal cross-section and said second locking element is a protrusion or pin perpendicular to the longitudinal axis of said stem, preferably in one single piece with the stem.

If desired, the fixing system according to the present invention may also comprise a third locking element. For example, said third locking element can be a deformable protrusion positioned between the first and second locking elements.

Furthermore, to facilitate its placement, rotation and removal, said stem comprises a cavity at its outer end to place a tool inside it, such as a wrench or the like. Advantageously, said cavity has a polygonal cross-section, for example square.

According to a preferred embodiment, the fixing system according to the present invention also comprises an outer body provided with a through hole for said stem, said locking elements protruding from said outer body.

According to this embodiment, said third locking element is preferably housed inside a housing, for example a through hole, of said outer body.

Furthermore, said outer body advantageously comprises a bearing surface, for example formed by a lower recess in said outer body.

This bearing surface is supported by a pivot support located in the cavity of the tooth-holder, and serves as a supporting point for locking and unlocking rotation of the pin system.

According to a preferred embodiment, the stem of the system for fixing wear elements in earth-moving machines according to the present invention comprises a cam-shaped groove that, in one position, pushes the third locking element.

Furthermore, the first locking element can comprise a tip, which advantageously comprises a greater thickness in its front part and is beveled, and the second locking element can comprise a ramp in the area joining the stem, which facilitate the compensation of tolerances.

BRIEF DESCRIPTION OF THE DRAWINGS

For a better understanding of what has been stated, some drawings are attached in which, schematically and only as a non-limiting example, a practical case of embodiment is shown.

DESCRIPTION OF PREFERRED EMBODIMENTS

Figure 1:
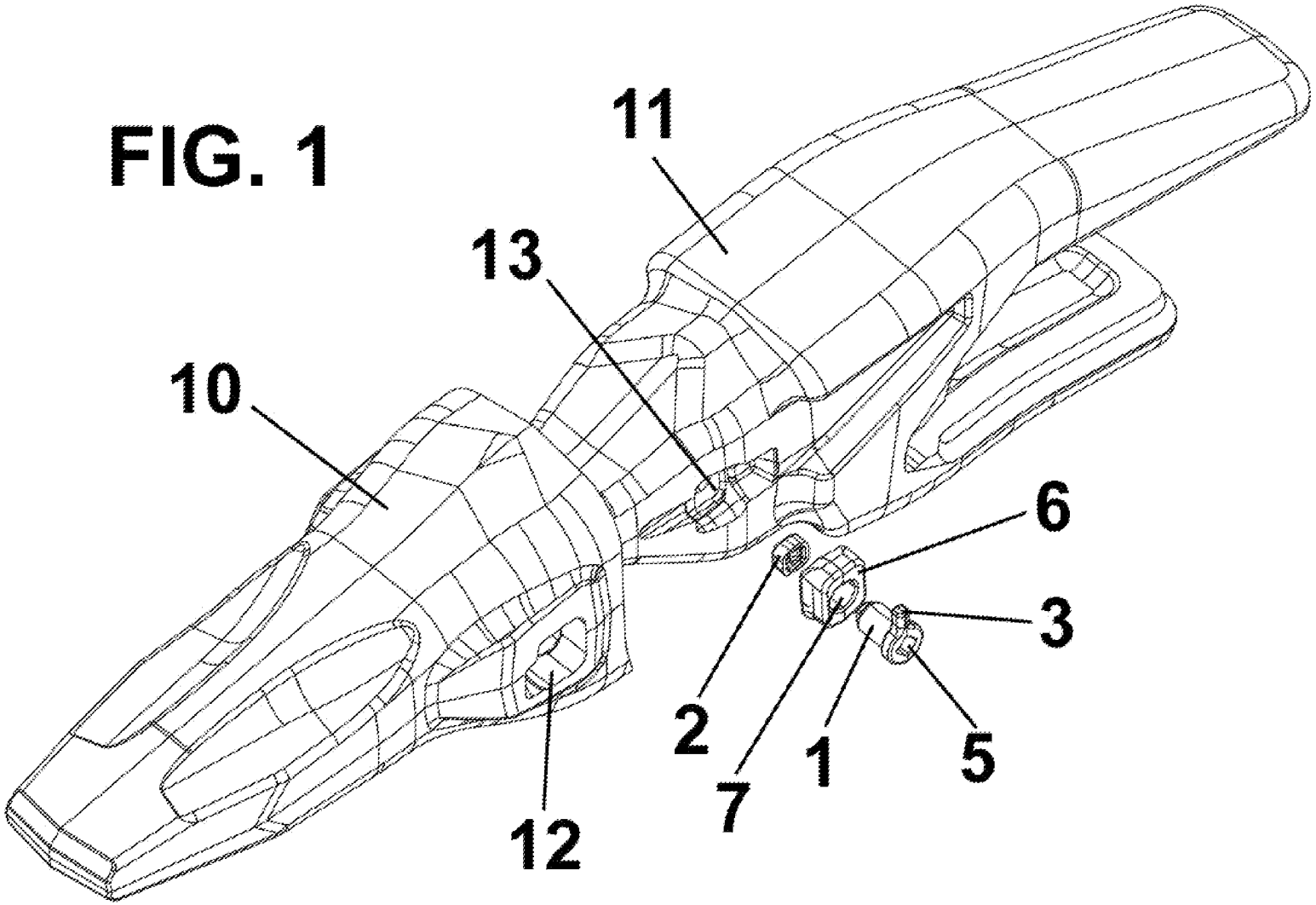
FIG. 1 is a perspective view of a tooth and tooth-holder assembly where the fixation system according to the present invention is used, according to a first embodiment.
Figure 5:
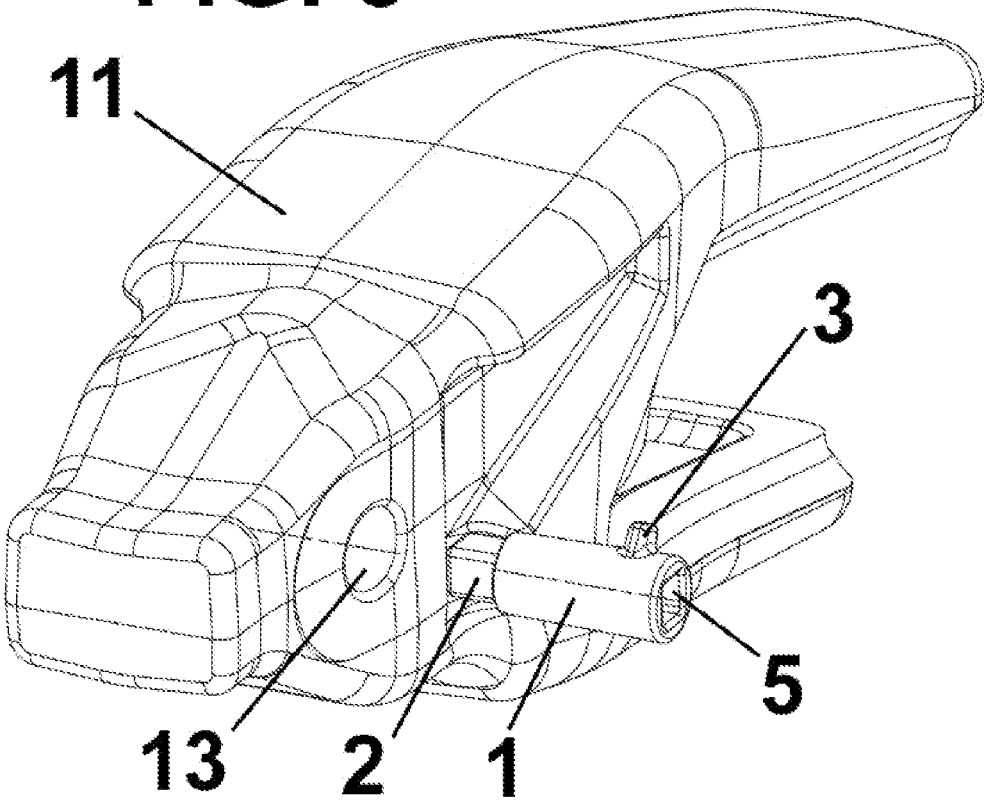
FIG. 5 is a perspective view of a tooth and tooth-holder assembly where the fixation system according to the present invention is used, according to a second embodiment.

First of all, it should be noted that, although in FIGS. 1 and 5 a tooth 10 and a tooth-holder 11 of an earth-moving machine have been shown, the fixing system according to the present invention can be used for fixing any wear element of an earth-moving machine.

As shown in FIG. 1, the fixing system according to the present invention is used to fix a tooth 10 to a tooth-holder 11. For this purpose, the tooth 10 comprises a through hole 12 and the tooth-holder 11 comprises a cavity 13.

Figure 2:
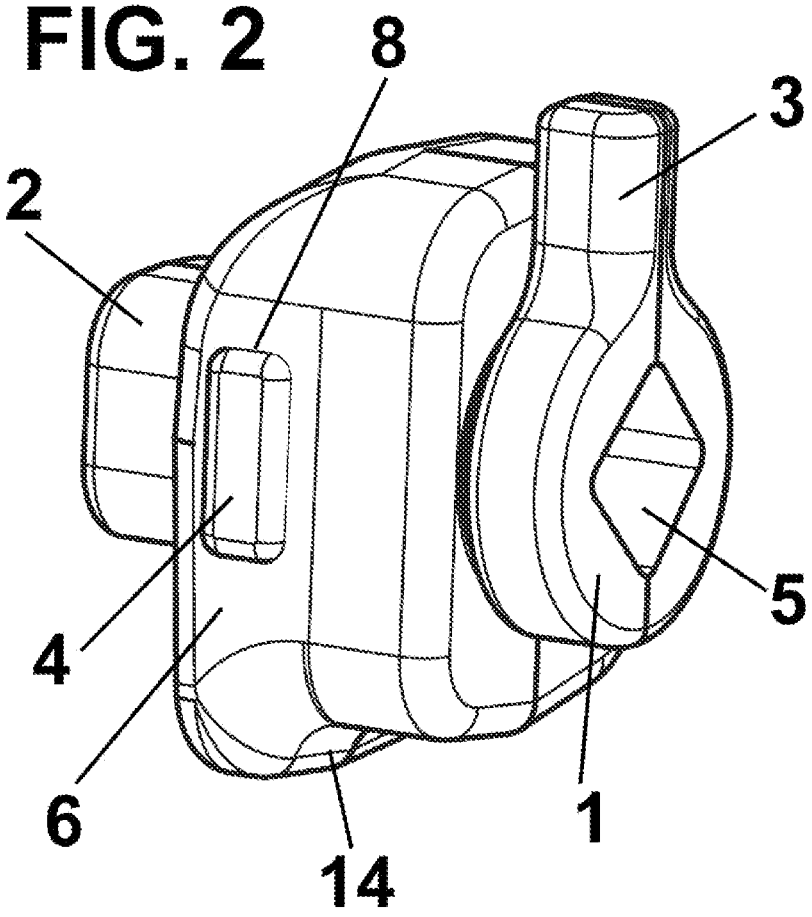
FIG. 2 is a perspective view of the fixing system of the present invention, according to said first embodiment.

As can be seen in greater detail in FIG. 2, the fixing system according to the present invention comprises a stem 1 that defines an inner end and an outer end, the inner end being the one that is inserted into the through hole 12 and in the cavity 13.

According to the embodiment shown, the stem 1 comprises a first locking element 2 at its inner end, a second locking element 3 shifted towards the outer end, that is, closer to the outer end than to the inner end or at the outer end itself, and a third locking element 4 (which is the one that tightens the pin), placing between the first and second locking elements 2, 3, on one side of said stem 1. In the latest versions, the first locking element 2, has an over thickness, which also tightens the pin, but in the longitudinal direction of the stem.

Said first locking element 2 is made of a deformable material, such as an elastic material, for example rubber, and has a polygonal cross-section, for example, substantially square with its rounded corners.

For its part, the second locking element 3 is preferably a protrusion or pin formed in a single piece with the stem 1 and extending perpendicular to the longitudinal axis of the stem 1. The function of the second locking element 3 is to abut against the tooth so that the pin does not slide out of the through hole of the tooth. Instead, the function of the first locking element 2 is to fix the position of the pin, or in a mounted position or a disassembly position, that is, to prevent rotation.

The third locking element 4 is also made of a deformable material, for example also made of elastic material, such as rubber. It should be noted that it can also be a combination of elastic material and hard or rigid material, such as, for example, steel, since that gives them more strength.

The function of this third locking element 4 is to abut against the tooth-holder, which as it is elastically loaded, and the tooth-holder is fixed, this retainer tends to go backwards from the assembly, pushing, at the same time, the tooth. The effect is the tightening of the tooth on the tooth-holder.

The mixture of elastic material and hard material provides more force to the retainer to push the tooth towards the tooth-holder.

The fixing system according to the present invention also comprises, according to this embodiment, an outer body 6 provided with a through hole 7 through which the stem 1 passes and with a housing 8 for the third locking element 4. As can be seen in FIG. 2, said locking elements 2, 3, 4 protrude with respect to said outer body 6.

Preferably, the housing 8 is a through hole, whereby the third locking element 4 contacts the stem 1.

In addition, said body 6 is provided with a bearing surface 14, which is supported by a rotation support 15 located in the cavity 13 of the tooth-holder 11. This support serves as a support point for the locking and unlocking rotation of the pin system.

According to a represented embodiment, said bearing surface 14 is formed by a lower recess in said outer body 6.

Figure 3:
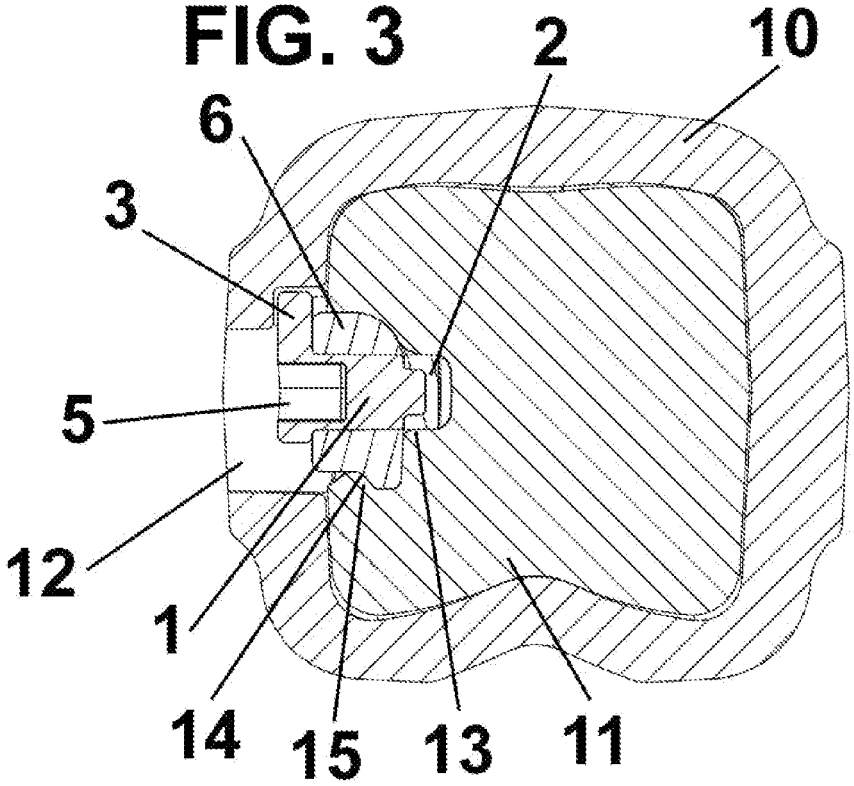
FIGS. 3 and 4 are cross-sectional views of the fixing system of the present invention, according to said first embodiment, in its locking and release position, respectively.
Figure 4:
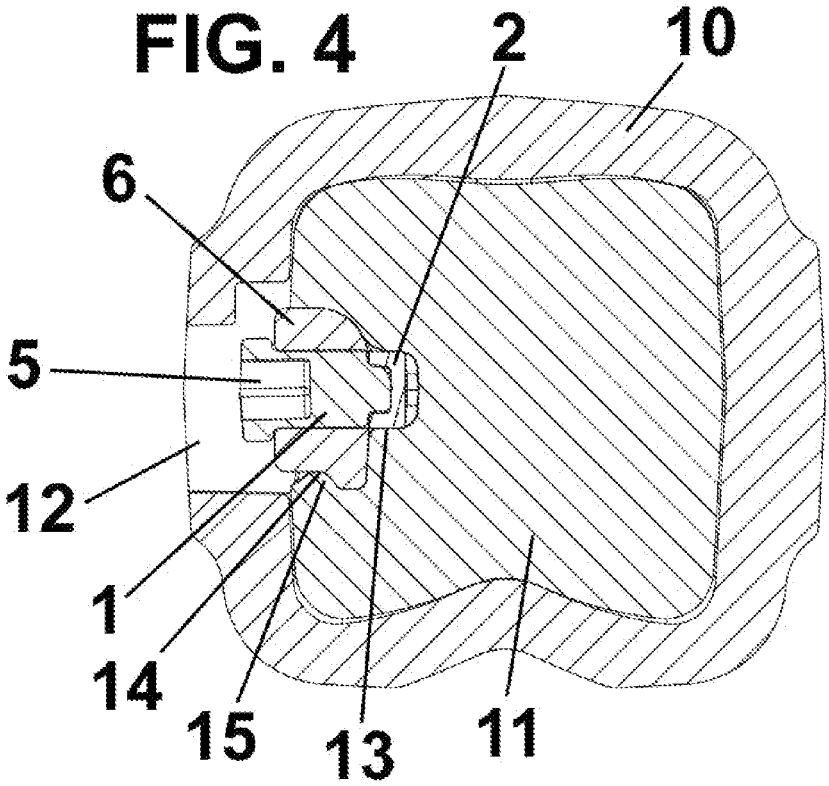

Said stem 1 is rotatable between a locking position and a release position (represented respectively in section in FIGS. 3 and 4). For this, the stem 1 comprises, at its outer end, a cavity 5, preferably with a polygonal cross-section, for the introduction of a complementary tool, for example, a wrench.

For placement and removal, said tool is placed in the cavity 5, the pin is inserted into the cavity 13 of the tooth-holder, passing through the through hole 12 of the tooth, and the support area 14 of the body 6 of the pin is supported on the rotation support 15, and it is rotated about 35°, and then the stem 1 is rotated 90° with respect to its longitudinal axis by means of said tool, passing from the release position to the locking position. Once in its locking position, the tool is removed. There are two movements with the tool.

In this locking position, the first locking element 2 is deformed against the cavity 13 of the tooth-holder 11, being compressed at its corners, until, after the 90° rotation, the corners recover their shape as they have reached the corners of the cavity 13, the first locking element being locked in the cavity 13, and locking the movement of the stem 1 and preventing the rotation of the pin.

It should be noted that the geometry of the cavity 13 where the first locking element 2 is located has the same geometry as it, that is, it is not round, so that when it is rotated 90°, the first locking element 2 rotates by deforming its corners according to the cavity 13, when the corners of the locking element 2 reach the next corners of the cavity 13, the corners of the locking element 2 are no longer compressed and are trapped in the cavity 13, being locked.

Furthermore, in the locked position, the second locking element 3 abuts against a groove formed in said through hole 12 of the tooth, locking the stem 1 in the longitudinal direction, that is, it prevents it from coming out of the through hole 12. This causes, during operation, unwanted vibrations and shocks not tend to push the pin out of its mounting position.

For its part, the third locking element 4 performs a friction or mechanical locking between the third locking element and the interior walls of the cavity 13 of the tooth-holder 11 and the interior walls of the through hole 12 of the tooth 10, which make the pin system to remain tightened in position, avoiding unwanted movements during work.

This third locking element 4 presses on the stem 1, also hindering its rotation, and at the same time hindering the rotation of the second locking element 3.

To remove it, the reverse operation must be carried out, also using said tool.

In FIG. 5 a second embodiment of the fixing system according to the present invention is shown.

For the purpose of clarity, same reference numerals are used to designate same elements as in the previous embodiment. Also, the common parts are not described in detail for the sake of simplicity.

As can be seen in this FIG. 5, in this embodiment the fixing system also comprises a stem 1 provided with a first locking element 2 and a second locking element 3, but it does not comprise the third locking element or the outer body.

Its operation and its placement and removal are the same as in the first embodiment described above.

Figure 6:
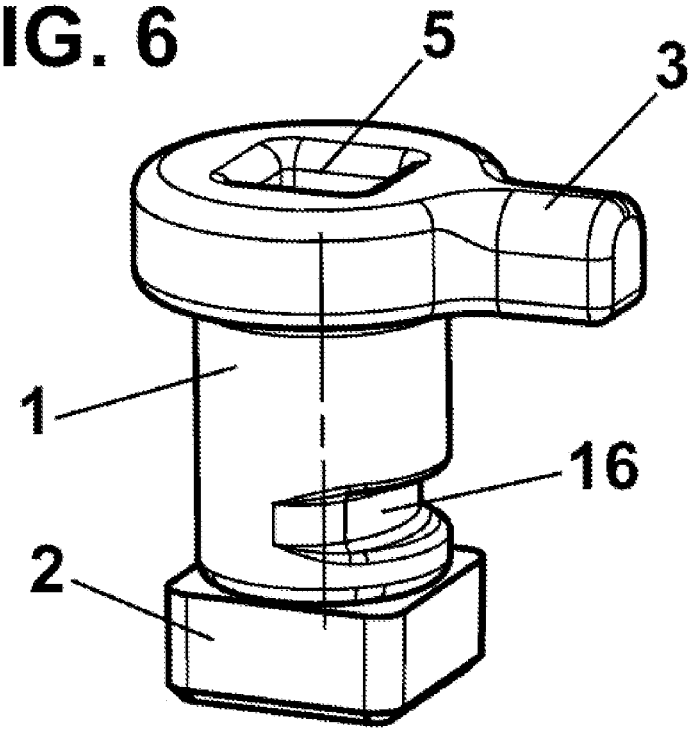
FIG. 6 is a perspective view of the fixing system of the present invention according to a third embodiment, in which the stem comprises a groove.
Figure 7:
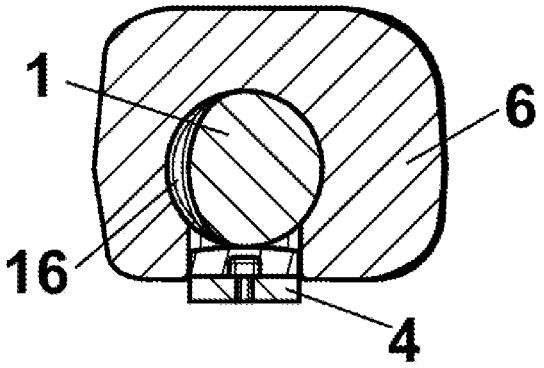
FIGS. 7 and 8 are sectional views of the fixing system of the present invention according to said third embodiment, in two different positions, in which the operation of the cam or groove is seen.
Figure 8:
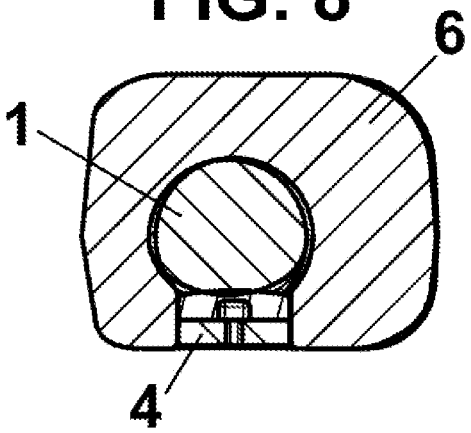

In FIGS. 6 to 8, a third embodiment of the fixing system according to the present invention is shown. The main difference of this third embodiment with respect to the first embodiment is that the stem 1 comprises a cam-shaped groove 16.

In this way, when stem 1 rotates, the widest area of stem 1 defined by the groove 16 pushes the third locking element 4, to contact the groove of the tooth-holder, that is, in the mounting position, as shown in FIG. 7, but in the position shown in FIG. 8, a part of the third locking element 4 remains housed in the groove 16, so that the third locking element 4 is not pushed (position in which the pin remains free, i.e. in disassembly position).

This feature improves the fixation of the third locking element 4. Furthermore, being preferably made of two materials, it exerts more force to tighten/push the tooth on the tooth-holder.

Figure 9:
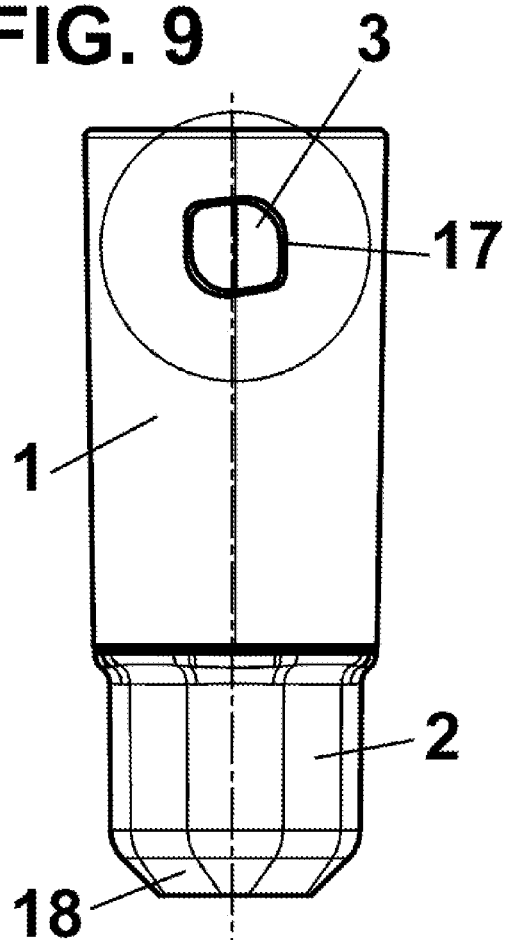
FIG. 9 is a front view of the fixing system of the present invention according to a fourth embodiment, wherein the second locking element comprises a ramp in the area joining the stem to compensate for tolerances.
Figure 10:
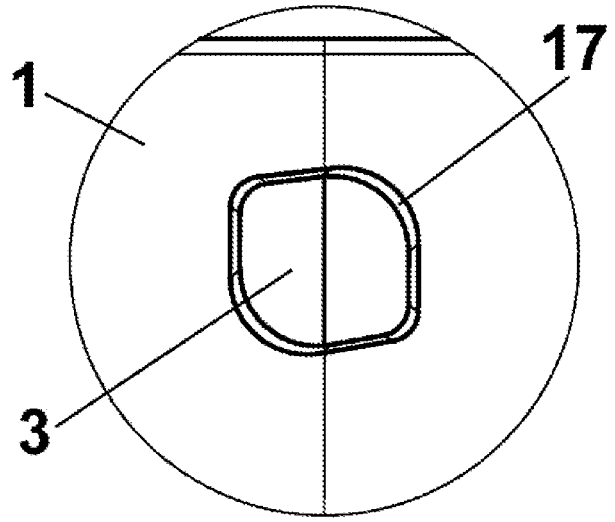
FIG. 10 is a detail of FIG. 9 to observe said ramp in greater detail.
Figure 11:
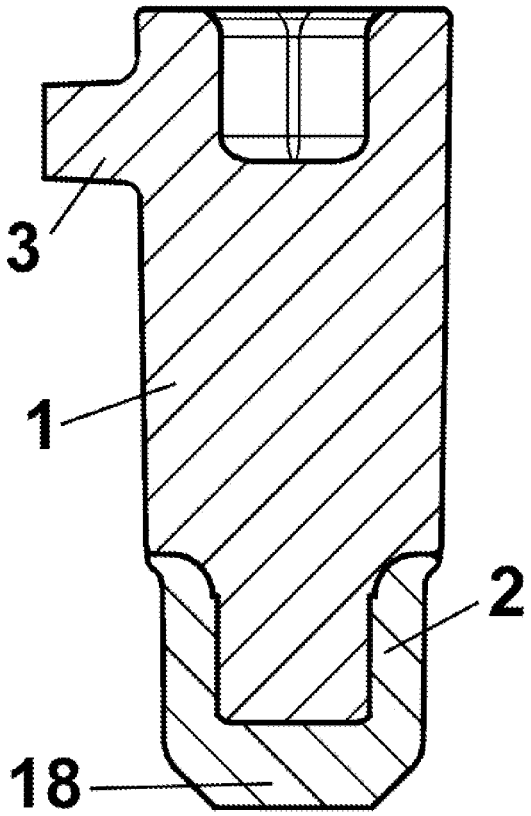
FIG. 11 is a sectional view of the fixing system of the present invention according to a fourth embodiment.

In FIGS. 9 to 11 a fourth embodiment of the fixing system according to the present invention is shown, which is very similar to the second embodiment.

The differences between the fourth and second embodiments have been made for the absorption of manufacturing tolerances.

First, the first locking element 2, which is preferably made of a deformable material, comprises a beveled tip 18 to better compact and exert more force, facilitating the absorption of tolerances.

Said tip 18 also comprises a greater thickness in its front part, as can be seen in FIG. 11.

The beveling of the tip 18 allows that, if the elastic material is compressed, there is space for the deformed material, but it is also important that when the stem is in the mounting position, the elastic material is compressed in the longitudinal direction of the stem 1, so that the stem 1 is pushed into the tooth groove.

The length of the first locking element provides the stem 1 a total length that is longer than the distance between the retention/contact of the second locking element 3 with the tooth and the internal face of the cavity 13.

Preferably, the length of the first locking element 2 is greater than the depth of the cavity 13, although it is not essential.

The objective is that, in the mounting position, the first locking element 2 is taut by this greater thickness of the front part of the tip 18 of the first retaining element 2.

In addition, the second locking element 3 comprises a ramp 17 in the area where it joins the stem 1, as best seen in FIG. 10.

This ramp 17 takes advantage of the force exerted by the first locking element 2 to extract the tooth and bring a hole in the tooth closer to the second locking element 3.

The preferable tilt for this ramp is 3 to 25 degrees, more specifically 5 to 10 degrees.

Being a point contact with the ramp 17, and under the pressure exerted against the tooth, the tooth tends to twist until it rests flat or touches the part of the hole against the second locking element 3, better absorbing manufacturing tolerances.

Although reference has been made to a specific embodiment of the invention, it is clear to a person skilled in the art that the described fixing system is susceptible to numerous variations and modifications, and that all the mentioned details can be technically replaced by other technically equivalent ones, without departing from the scope of protection defined by the appended claims.

The invention claimed is:

1. A system for fixing wear elements in earth-moving machines, comprising:

a stem that rotates between a locking position and a release position, said stem comprising an inner end and an outer end along a longitudinal axis, wherein said stem comprises a plurality of locking elements comprising a first deformable locking element placed at and extending from said inner end of said stem perpendicularly to said longitudinal axis as a tip terminating at a front part, and a second locking element arranged towards said outer end of said stem;

wherein said first locking element is adapted to be received in a cavity of a portion of a wear element or a portion of an earth-moving machine mounting said wear element, said tip being formed from a deformable material adapted to lock movement of said stem by deformation when rotated from said release position to said locking position when received in said cavity; and wherein said front part comprises a greater thickness at said front part than a remainder of said tip, said greater thickness adapted to compress along said longitudinal axis into said cavity during rotation of said stem from said release position and said locking position.

2. A system for fixing wear elements in earth-moving machines, comprising:

a stem that rotates between a locking position and a release position, said stem comprising an inner end and an outer end along a longitudinal axis, wherein said stem comprises a plurality of locking elements comprising a first deformable locking element placed at and extending from said inner end of said stem perpendicularly to said longitudinal axis as a tip terminating at a front part, and a second locking element arranged towards said outer end of said stem;

wherein said first locking element is adapted to be received in a cavity of a portion of a wear element or a portion of an earth-moving machine mounting said wear element, said tip being formed from a deformable material adapted to lock movement of said stem by deformation when rotated from said release position to said locking position when received in said cavity; and wherein said first locking element has a polygonal cross-section having tip corners adapted to be received in said cavity having a polygonal cross-section with cavity corners in said release position, said tip corners being adapted to deform to shift between cavity corners to lock said stem in position when rotated to said locking position.

3. The system for fixing wear elements in earth-moving machines according to claim 1, wherein said front part comprises a greater thickness at said front part than a remainder of said tip, said greater thickness adapted to compress along said longitudinal axis into said cavity during rotation of said stem from said release position and said locking position.

4. A system for fixing wear elements in earth-moving machines, comprising:

a stem that rotates between a locking position and a release position, said stem comprising an inner end and an outer end along a longitudinal axis, wherein said stem comprises a plurality of locking elements comprising a first deformable locking element placed at and extending from said inner end of said stem perpendicularly to said longitudinal axis as a tip terminating at a front part, and a second locking element arranged towards said outer end of said stem; and a third locking element having a deformable protrusion positioned between said first and second locking element;

wherein said first locking element is adapted to be received in a cavity of a portion of a wear element or a portion of an earth-moving machine mounting said wear element, said tip being formed from a deformable material adapted to lock movement of said stem by deformation when rotated from said release position to said locking position when received in said cavity.

5. The system for fixing wear elements in earth-moving machines according to claim 1, wherein said third locking element is adapted to deform when said stem rotates to said locking position to abut said stem and said cavity.

6. The system for fixing wear elements in earth-moving machines according to claim 1, wherein said stem comprises a tool cavity at its outer end.

7. The system for fixing wear elements in earth-moving machines according to claim 6, wherein said cavity of said stem has a polygonal cross-section.

8. The system for fixing wear elements in earth-moving machines according to claim 1, further comprising an outer body provided with a through hole for said stem, said locking elements protruding from said outer body.

9. The system for fixing wear elements in earth-moving machines according to claim 4, wherein said third locking element is housed inside a housing of an outer body.

10. The system for fixing wear elements in earth-moving machines according to claim 3, wherein said second locking element is in one single piece with thesaid stem.

11. The system for fixing wear elements in earth-moving machines according to claim 8, wherein said outer body comprises a bearing surface.

12. The system for fixing wear elements in earth-moving machines according to claim 11, wherein said bearing surface is formed by a lower protrusion on said outer body.

13. The system for fixing wear elements in earth-moving machines according to claim 9, wherein said housing is a through hole.

14. The system for fixing wear elements in earth-moving machines according to claim 4, wherein said stem comprises a cam-shaped groove that, in one position, pushes said third locking element.

15. The system for fixing wear elements in earth-moving machines according to claim 1, wherein said cavity is formed in said earth-moving machine mounting comprising a tooth holder and said stem fixing said tooth holder to said wear element comprising a tooth.

16. The system for fixing wear elements in earth-moving machines according to claim 1, wherein said first locking element comprises a beveled tip.

17. The system for fixing wear elements in earth-moving machines according to claim 3, wherein said second locking element comprises a ramp in an area joining said stem.

18. The system for fixing wear elements in earth-moving machines according to claim 16, wherein said beveled tip forms spaces between said tip and said cavity when received in said cavity.

19. The system for fixing wear elements in earth-moving machines according to claim 18, wherein said spaces are adapted to provide space for deformed material of said tip when in said locking position.

20. The system for fixing wear elements in earth-moving machines according to claim 14, wherein said third locking element abuts and elastically loads said earth-moving machine mounting comprising a tooth holder against said wear element comprising a tooth.

* * * * *